US005150578A

United States Patent [19]

Oota et al.

[11] Patent Number: 5,150,578

[45] Date of Patent: Sep. 29, 1992

[54] CRYOSTAT

[75] Inventors: Hisasi Oota; Kazuki Moritsu, both of Akou, Japan

[73] Assignee: Mitsubishi Denki K.K., Tokyo, Japan

[21] Appl. No.: 755,240

[22] Filed: Sep. 5, 1991

[30] Foreign Application Priority Data

Sep. 5, 1990 [JP] Japan ..... 2-238691
Nov. 15, 1990 [JP] Japan ..... 2-307163

[51] Int. Cl.[5] ..... F17C 5/02

[52] U.S. Cl. ..... 62/47.1; 62/51.1; 505/892

[58] Field of Search ..... 62/47.1, 51.1; 505/892

[56] References Cited

U.S. PATENT DOCUMENTS

| | | | |
|---|---|---|---|
| 2,964,916 | 12/1960 | Keeping | 62/47.1 |
| 2,976,695 | 3/1961 | Meade | 62/48.2 |
| 3,096,625 | 7/1963 | Legatski | 62/47.1 |
| 3,150,495 | 9/1964 | Reed | 62/48.2 |
| 3,191,395 | 6/1965 | Maher et al. | 62/47.1 |
| 3,293,870 | 12/1966 | Folz | 62/47.1 |
| 4,223,540 | 9/1980 | Longsworth | 62/51.1 |
| 4,277,949 | 7/1981 | Longsworth | 62/47.1 |
| 4,543,794 | 10/1985 | Matsutani et al. | 62/47.1 |
| 4,796,433 | 1/1989 | Bartlett | 62/47.1 |

FOREIGN PATENT DOCUMENTS 72799 4/1983 Japan .

*Primary Examiner*—Ronald C. Capossela
*Attorney, Agent, or Firm*—Sughrue, Mion, Zinn, Macpeak & Seas

[57] ABSTRACT

In a cryostat comprising a cryogen container for containing a liquid cryogen, and a refrigerator for recondensing a cryogen gas resulting from evaporating of the liquid cryogen, the pressure within the cryogen container is detected, and when the pressure falls to a negative value due to excessive cooling, a heater is turned on to raise the temperature thereby to enhance the evaporation. As an alternative, the refrigerator may be turned off or its power may be lowered. This will increase the pressure within the cryogen container. When the pressure rises to a positive value, the heater is turned off or the refrigerator is turned on or its power is raised. Through such control, the pressure can be maintained at a constant, positive value. As a result, deformation of the cryogen container due to pressure variation is avoided, and deformation of the superconducting coil wound on the cryogen container is avoided, and the magnetic field strength and the magnetic field uniformity can be maintained constant.

32 Claims, 5 Drawing Sheets

CRYOSTAT

FIELD OF THE INVENTION

The present invention relates to a cryostat used for example for cooling a superconducting magnet in a nuclear magnetic resonance (NMR) imaging apparatus, and in particular to a cryostat provided with a refrigerator for recondensing the cryogen, such as a helium gas.

BACKGROUND OF THE INVENTION

FIG. 1 is a sectional view showing a conventional cryostat. As illustrated, liquid cryogen, such as liquid helium 1, which is a liquefied gas, is contained in a cryogen container 2 accommodating a superconducting magnet including a superconducting coil 10 wound in the interior of the cryogen container 2. A helium gas 3, which results from evaporation of the liquid helium, is in the helium gas container 2, and is staying above the liquid surface. A heat shield (radiation shield) 4 is provided to surround the cryogen container 2. A vacuum container 5 is provided to surround the heat shield 4 and maintain its interior in a vacuum state. A refrigerator system 6 is provided for cooling the heat shield 4 and recondensing the helium gas 3 in the cryogen container 2. The refrigerator system 6 comprises a refrigerator unit 7 and a compressor unit 8. The refrigerator unit 7 has a main block *7a* situated outside the vacuum container 5, an elongated, e.g., cylindrical part *7b* which extends through the walls of the vacuum container 5 and the heat shield 4 having first-stage and second-stage cooling sections *7c* and *7d* which are disposed near the walls of the heat shield 4 and the cryogen container 2 and thermally connected therewith for cooling the heat shield 4 and the cryogen container 2, respectively.

The operation will next be described. The liquid helium 1 cools the superconducting magnet. The heat shield 4 reduces infiltration of heat from outside to inside of the cryogen container 2. The surrounding vacuum container 2 further gives vacuum heat insulation. But there is still some infiltration of heat, and, for this reason, the liquid helium evaporates to become the helium gas 3. The refrigerator system 6 recondenses the helium gas to restrain reduction in the amount of the liquid helium 1.

A problem associated with the conventional cryostat configured as described above is that when the cooling by the refrigerator is excessive and the condensation of the evaporated gas proceeds excessively, the interior of the container containing the liquid gas may be of a negative pressure, and air may be drawn into the container from a tube extending to the exterior. Also, due to the variation in the interior pressure, the container 2 may be deformed, and, the superconducting coil 10 wound on the inner wall surface of the cryogen container 2 may also be deformed, and the magnetic field strength and the magnetic filed uniformity may be affected.

SUMMARY OF THE INVENTION

The present invention has been made to eliminate the problems mentioned above, and its object is to provide a cryostat in which the interior pressure of the container containing the liquefied gas can be maintained constant, at a positive value.

The cryostat according to the invention comprises a pressure sensor for detecting the pressure of the gas within the container and a heater for heating the interior of the container, wherein the operation of the heater is controlled in accordance with a signal from the pressure sensor.

In an alternative arrangement, the heater is not provided, and the operation of the refrigerator is controlled in accordance with the signal from the pressure sensor.

In the cryostat according to the invention, when the pressure of the gas within the container is lowered, the heater is operated or the refrigerator is stopped or is slowed down, so the temperature of the interior of the container can be raised to maintain the interior pressure at a positive, constant value.

DETAILED DESCRIPTION OF THE PREFERRED EMBODIMENTS

Figure 1:
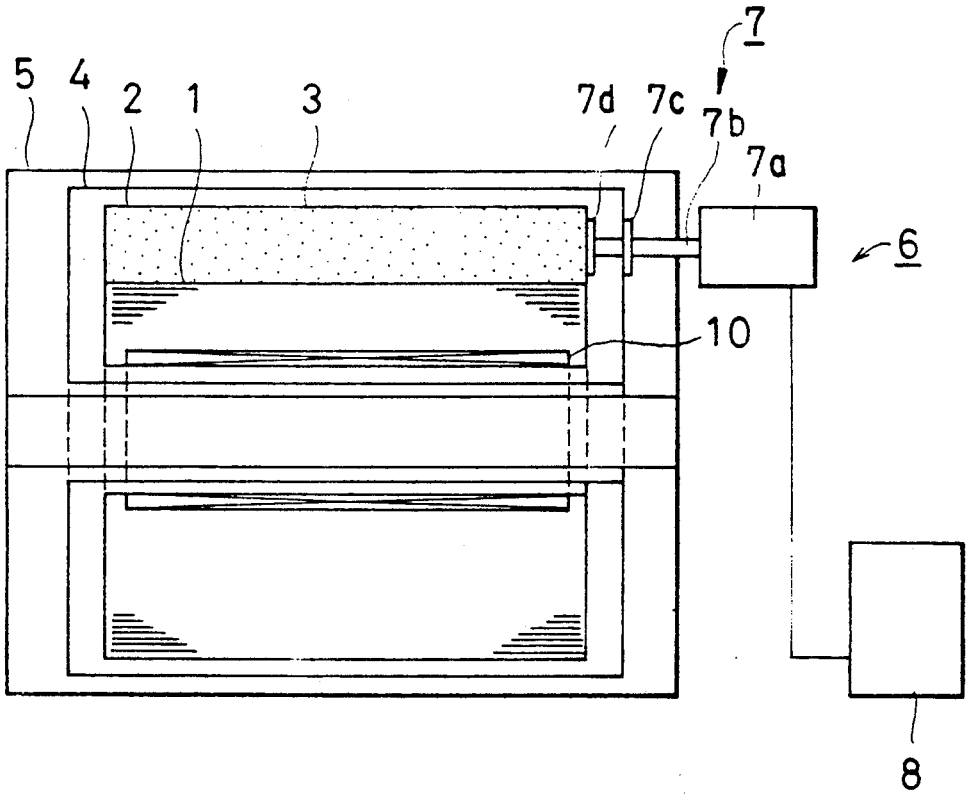
FIG. 1 PRIOR ART
FIG. 1 is a sectional view showing a conventional cryostat.
Figure 2:
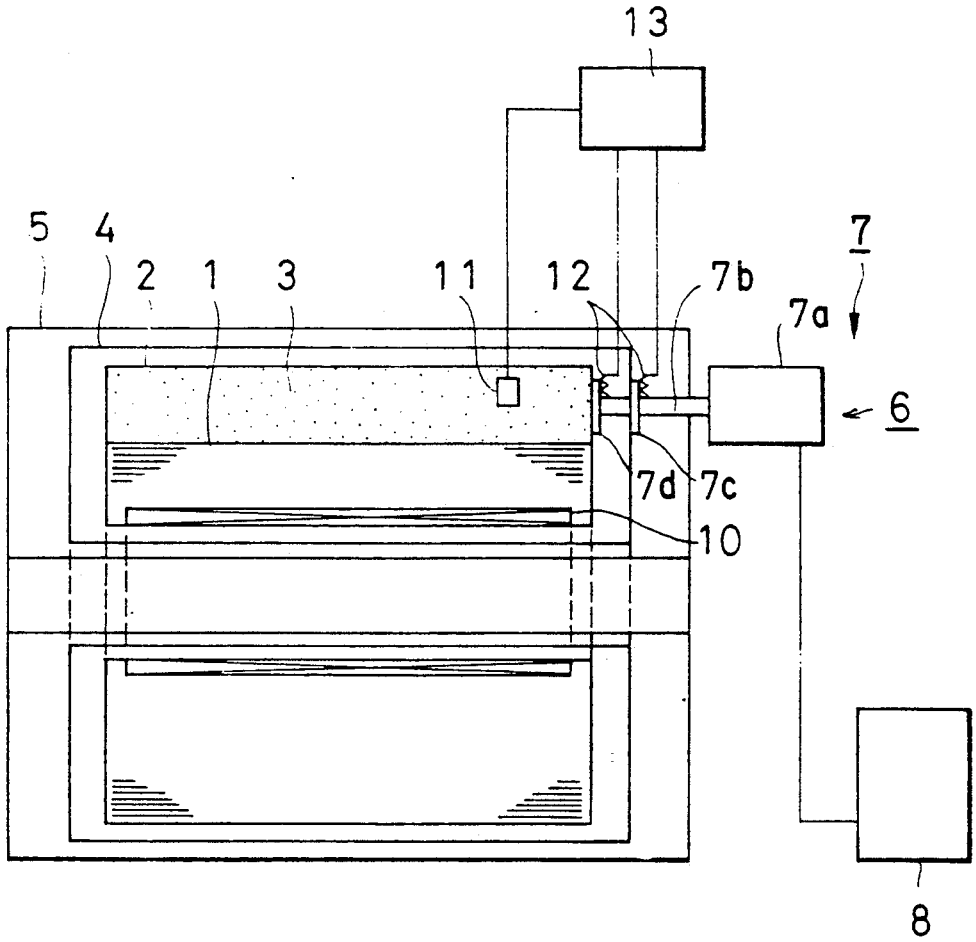
FIG. 2 is a structure diagram of a cryostat of an embodiment of the invention.

An embodiment of the invention will now be described with reference to the drawings. FIG. 2 is a structure diagram showing an embodiment of the invention. In the figure, parts identical or corresponding to those in FIG. 1 are denoted by identical reference marks, and their description is omitted.

Additionally, the cryostat of this embodiment is provided with a pressure sensor 11 for detecting the pressure of the interior of the cryogen container 2. A pressure controller 13 is responsive to a pressure signal from the pressure sensor 11 for maintaining the pressure at a constant, positive value. The pressure controller 13 of this embodiment controls energization of electric heaters 12 mounted at the first-stage and second-stage cooling sections *7c* and *7d* in accordance with the detected pressure.

More specifically, the pressure controller 13 compares the detected pressure with a reference value. The reference value may be set substantially equal to or is slightly above the atmospheric pressure. The "atmospheric pressure" may be a fixed value equal to an average atmospheric value or a measured value which varies with time.

When the detected pressure falls below the reference value, the pressure controller starts energization of the heaters 12. When the detected pressure rises above the reference value, the pressure controller 13 stops energization of the heaters 12. In this way, it maintains the pressure in the cryogen container 2 at the reference value.

In operation, when the pressure of the interior of the cryogen container 2 falls below the reference value or becomes negative, this is detected by the pressure sensor 11, and the heaters 12 are turned on, and the overall cooling power of the cryostat is lowered, and the temperature of the cryogen container 2 and the heat shield 3 increases. As a result, evaporation of the liquid helium 1 is promoted and the pressure within the cryogen container 2 increases. When the pressure rises above the reference value and becomes positive, the heaters 12 are turned off, and the overall cooling power of the cryostat is returned to the original value, and the evaporation of the liquid helium 1 is restrained.

In this way, even if the excessive cooling is made by the refrigerator system 6, the pressure of the helium gas 3 is maintained at a substantially constant, positive value.

FIGS. 3-7 show other embodiments of the invention. In these figures, the superconducting coil 10 shown in FIG. 1 and FIG. 2 is omitted.

Figure 3:
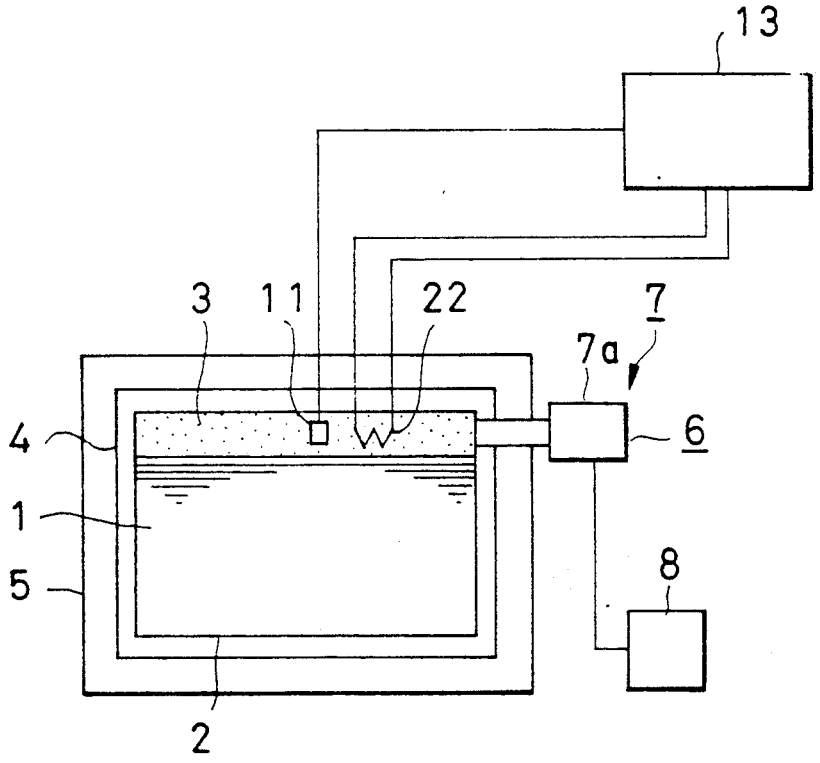
FIG. 3 to FIG. 7 are sectional views showing cryostats of other embodiments of the invention.

The embodiment of FIG. 3 differs from the embodiment of FIG. 2 in that a single heater 22 is disposed within the cryogen container 2. When the heater 22 is turned on, it heats the interior of the cryogen container 2 to promote evaporation of the liquid helium 1.

The on/off control of the heater 22 is made in the same way as the on/off control of the heaters 12 of the embodiment of FIG. 2.

Figure 4:
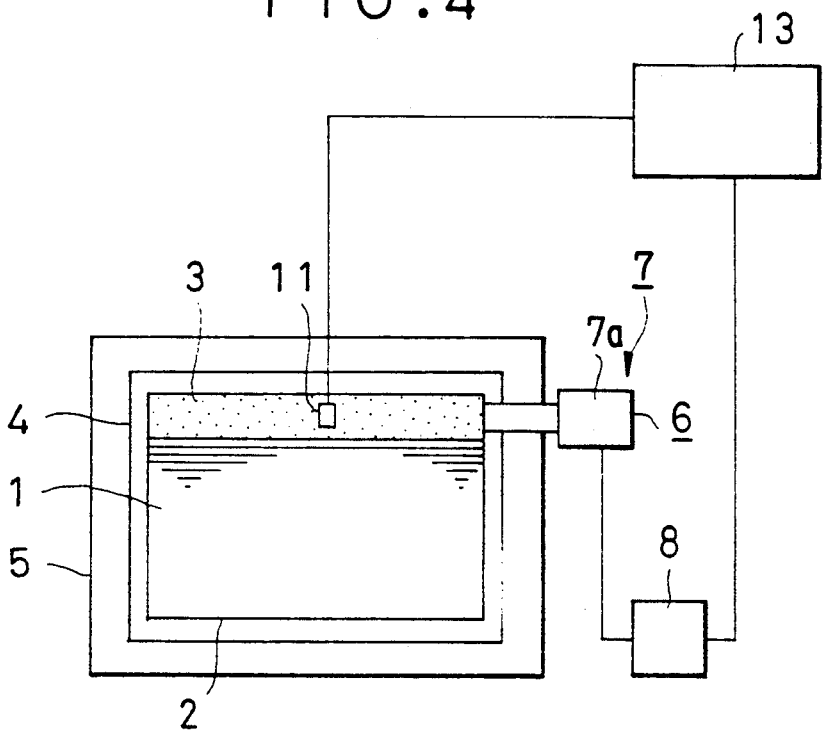

In the embodiment of FIG. 4, no heaters are provided, and the operation of the compressor unit 8 is controlled by the pressure controller 13. When the pressure of the helium gas 3 becomes negative, this is detected by the pressure sensor 11, and the pressure controller 13 turns off or stops the operation of the compressor unit 8. As a result, the temperature of the cryogen container 2 and the heat shield 4 is increased, and the liquid helium 1 is evaporated. When the pressure of the helium gas 3 returns to a positive value, the compressor unit 8 is turned on or restarted.

Figure 5:
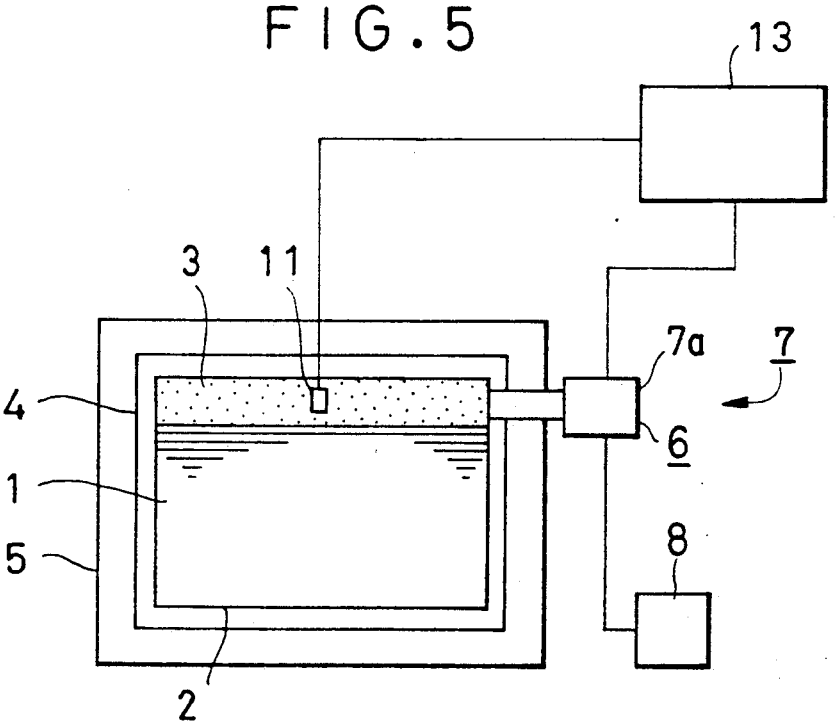

Instead of controlling the operation of the compressor unit 8, the operation of the refrigerator unit 7 may be controlled as illustrated in FIG. 5.

Figure 6:
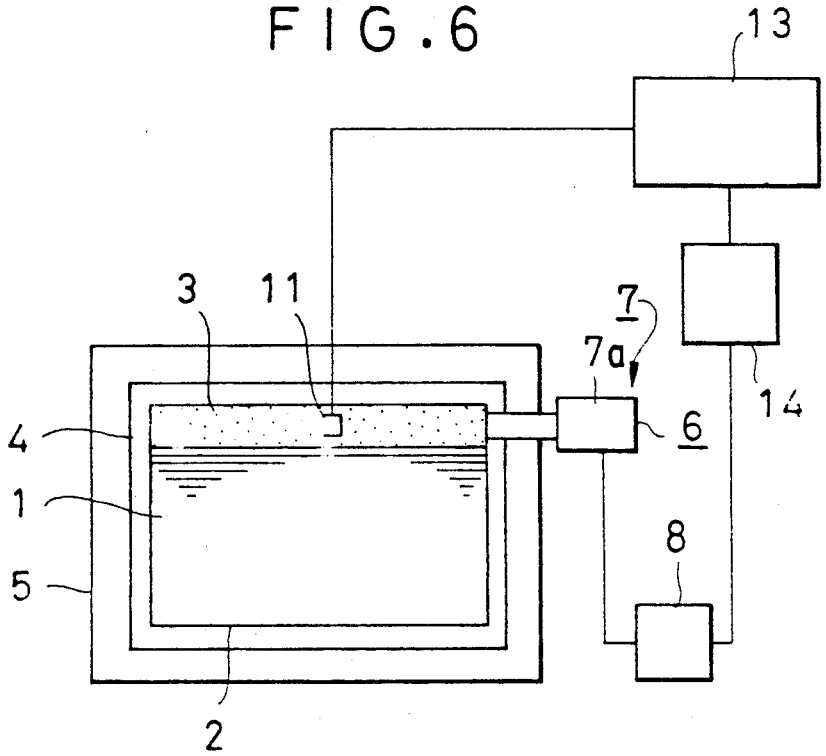

FIG. 6 is a sectional view showing a cryostat of a further embodiment of the invention. The cryostat of this embodiment is provided with an inverter 14 capable of providing a.c. electric power of variable frequency, and thereby capable of driving the compressor unit 8 at a variable speed, and hence capable of varying the refrigeration power of the refrigerator system 6. The operation of the inverter 14 is controlled by the pressure controller 13.

When the pressure of the helium gas 3 becomes negative, the pressure controller 13 controls the inverter 14 to lower the rotational speed of the compressor unit 8 thereby to lower the power of the refrigerator system 6, thereby to increase the temperature of the cryogen container 2 and the heat shield 4. When the liquid helium 1 evaporates and the pressure of the helium gas 3 becomes positive, the rotational speed of the compressor unit 8 is raised, e.g., back to the original value.

Figure 7:
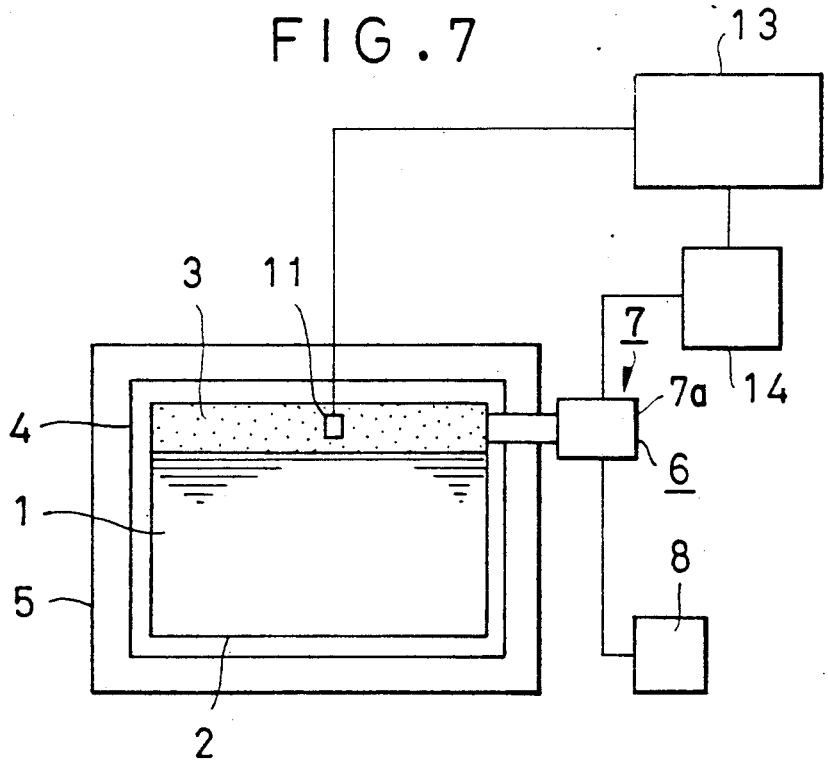

In this embodiment, the inverter 14 is used to vary the speed of the compressor unit 8. But as shown in FIG. 7, the inverter 14 may be used to vary the speed of the refrigerator unit 7.

In the above embodiment, liquid helium is used as the liquid cryogen. But the invention is not limited to this, but is applicable where the liquid nitrogen is used.

As has been described, according to the invention, the operation of the heater or the refrigerator is controlled in accordance with the pressure sensor detecting the pressure of the gas within the container containing a liquid gas. When the pressure of the gas decreases due to excessive cooling by the refrigerator, the heater is turned on or the refrigerator is turned off or slowed down, so the pressure of the gas is increased and the pressure within the container can be maintained at a substantially constant, positive value. As a result, deformation of the cryogen container due to pressure variation is avoided, and deformation of the superconducting coil wound on the cryogen container is avoided, and the magnetic field strength and the magnetic field uniformity can thus be maintained constant.

What is claimed is:

1. A cryostat comprising:

a cryogen container (2) for containing a liquid cryogen;

a refrigerator system (6) for recondensing a cryogen gas resulting from evaporation of the liquid cryogen;

a pressure sensor (11) for detecting the pressure of the interior of the cryogen container (2); and pressure control means responsive to a detected pressure for maintaining the interior of the cryogen container (2) at a predetermined constant pressure, wherein said pressure control means comprises:

a heater (12) for heating the interior of the container; and a pressure controller (13) responsive to a signal from the pressure sensor (11) for controlling energization of the heater (12) to maintain the interior of the cryogen container (2) at a predetermined, constant pressure.

2. The device of claim 1, wherein said heater (12) is disposed at a cooling section of the refrigerator system.

3. The device of claim 2, wherein said cooling section forms a part at which the refrigerator system is thermally coupled with the cryogen container.

4. The device of claim 2, further comprising:

a heat shield (4) surrounding the cryogen container (2); and a vacuum container (5) surrounding the heat shield (4) and providing a vacuum heat insulation;

wherein said cooling section forms a part at which the refrigerator system is thermally coupled with the heat shield or the cryogen container.

5. The device of claim 1, wherein said pressure controller (13) turns on the heater (12) when the detected pressure falls below a reference value.

6. The device of claim 5, wherein said reference value is set substantially equal to or slightly above the atmospheric pressure.

7. The device of claim 6, wherein said atmospheric pressure is a fixed average atmospheric pressure or a measured atmospheric pressure.

8. The device of claim 1, further comprising:

a heat shield (4) surrounding the cryogen container (2); and a vacuum container (5) surrounding the heat shield (4) and providing a vacuum heat insulation.

9. A cryostat comprising:

a cryogen container (2) for containing a liquid cryogen;

a refrigerator system (6) for recondensing a cryogen gas resulting from evaporation of the liquid cryogen;

a pressure sensor (11) for detecting the pressure of the interior of the cryogen container (2); and pressure control means responsive to a detected pressure for maintaining the interior of the cryogen container (2) at a predetermined constant pressure, wherein said pressure control means comprises a pressure controller (13) responsive to a signal from the pressure sensor (11) for controlling the operation of the refrigerator system (6).

10. The device of claim 9, wherein said pressure control means turns off the refrigerator system (6) when the detected pressure falls below a reference value.

11. The device of claim 10, wherein said reference value is set substantially equal to or slightly above the atmospheric pressure.

12. The device of claim 11, wherein said atmospheric pressure is a fixed average atmospheric pressure or a measured atmospheric pressure.

13. The device of claim 9, further comprising drive means (14) for varying the power of the refrigerator system, and said pressure controller causes said drive means (14) to lower the power of the refrigerator system when the detected pressure is increased.

14. The device of claim 9, wherein said refrigerator system (6) comprises a compressor unit (8) and refrigerator unit (7).

15. The device of claim 9, wherein said pressure control means turns on the refrigerator system (6) when the detected pressure exceeds a reference value.

16. The device of claim 15, wherein said reference value is set substantially equal to or slightly above the atmospheric pressure.

17. The device of claim 15, wherein said reference value is a fixed average atmospheric pressure or a measured atmospheric pressure.

18. A cryostat comprising:

a superconducting coil (10) for generating a magnetic field;

a liquid cryogen (1) for cooling the cuperconducting coil;

a cryogen container (2) for containing the superconducting coil and the liquid cryogen;

a heat insulating means (4,5) for insulating transmission of heat to the cryogen container;

a refrigerator system (6) for cooling the cryogen container and restraining the evaporation of the liquid cryogen; and a pressure control system for maintaining constant the pressure in the cryogen container so as to maintain constant the intensity of the magnetic field or the uniformity of the magnetic field.

19. The cryostat of claim 18, wherein said pressure control system comprises:

a pressure sensor (11) for detecting the pressure in the cryogen container (2);

a pressure control means (12, 13; 13, 22; 6, 13; 6, 12, 14) responsive to a detected pressure for maintaining the interior of the cryogen container (2) at a predetermined constant pressure.

20. The device of claim 19, wherein said pressure control means comprises:

a heater (12) for heating the interior of the container; and a pressure controller (13) responsive to a signal from the pressure sensor (11) for controlling energization of the heater (12) to maintain the interior of the cryogen container (2) at a predetermined constant pressure.

21. The device of claim 20, wherein said pressure controller (13) turns on the heater (12) when the detected pressure falls below a reference value.

22. The device of claim 21, wherein said reference value is set substantially equal to or slightly above the atmospheric pressure.

23. The device of claim 22, wherein said atmospheric pressure is a fixed average atmospheric pressure or a measured atmospheric pressure.

24. The device of claim 20, wherein said heater (12) is disposed at a cooling section of the refrigerator system.

25. The device of claim 24, wherein said cooling section forms a part at which the refrigerator system is thermally coupled with the cryogen container.

26. The device of claim 24, wherein said heat insulation means comprises:

a heat shield (4) surrounding the cryogen container (2); and a vacuum container (5) surrounding the heat shield (4) and providing a vacuum heat insulation;

wherein said cooling section forms a part at which the refrigerator system is thermally coupled with the heat shield or the cryogen container.

27. The device of claim 19, wherein said pressure control means comprises a pressure controller (13) responsive to a signal from the pressure sensor (11) for controlling the operation of the refrigerator system (6).

28. The device of claim 27, wherein said pressure control means (11) turns off the refrigerator system (6) when the detected pressure falls below a reference value.

29. The device of claim 28, wherein said reference value is set substantially equal to or slightly above the atmospheric pressure.

30. The device of claim 29, wherein said atmospheric pressure is a fixed average atmospheric pressure or a measured atmospheric pressure.

31. The device of claim 27, further comprising drive means (14) for varying the power of the refrigerator system, and said pressure controller causes said drive means (14) to lower the power of the refrigerator system when the detected pressure is increased.

32. The device of claim 18, wherein said heat insulation means comprises:

a heat shield (4) surrounding the cryogen container (2); and a vacuum container (5) surrounding the heat shield (4) and providing a vacuum heat insulation.

* * * * *